United States Patent [19]

Beery

[11] 4,113,249

[45] Sep. 12, 1978

[54] GOLF CLUB AND MANUFACTURE THEREOF

[75] Inventor: Peter W. Beery, Setauket, N.Y.

[73] Assignee: Golf Resources, Ltd., Setauket, N.Y.

[21] Appl. No.: 803,976

[22] Filed: Jun. 6, 1977

Related U.S. Application Data

[63] Continuation-in-part of Ser. No. 565,379, Apr. 7, 1975, abandoned.

[51] Int. Cl.[2] ..... A63B 53/04

[52] U.S. Cl. ..... 273/78

[58] Field of Search ..... 273/77 R, 78, 80.2, 273/79, 80 C, 167-175

[56] References Cited

U.S. PATENT DOCUMENTS

| | | | |
|---|---|---|---|
| D. 238,285 | 12/1975 | Ross | 273/78 X |
| 863,728 | 8/1907 | Legh | 273/78 X |
| 2,040,252 | 5/1936 | Farrington | 273/78 |
| 2,174,212 | 9/1939 | Newsome | 273/78 X |
| 2,592,013 | 4/1952 | Curley | 273/170 |
| 3,212,783 | 10/1965 | Bradley et al. | 273/80.2 X |
| 3,387,844 | 6/1968 | Shippee | 273/167 H X |
| 3,390,881 | 7/1968 | Senne | 273/167 R X |
| 3,578,332 | 5/1971 | Caldwell | 273/78 X |
| 3,695,618 | 10/1972 | Woolley et al. | 273/173 |
| 3,817,522 | 6/1974 | Simmons | 273/167 J X |
| 3,843,122 | 10/1974 | Florian | 273/167 F X |

FOREIGN PATENT DOCUMENTS

| | | | |
|---|---|---|---|
| 211,781 | 12/1957 | Australia | 273/167 H |
| 692,197 | 8/1964 | Canada | 273/169 |
| 24,274 of | 1898 | United Kingdom | 273/78 |
| 679,292 | 9/1952 | United Kingdom | 273/167 H |
| 986,979 | 3/1965 | United Kingdom | 273/167 F |
| 323,897 | 1/1930 | United Kingdom | 273/167 R |
| 4,784 of | 1908 | United Kingdom | 273/170 |

*Primary Examiner*—Richard J. Apley
*Attorney, Agent, or Firm*—Alexander Mencher

[57] ABSTRACT

Structure and method of manufacture of a golf club such as a putter and comprising a metallic and cavitied die-cast head core, an impact vibratory plate member over the cavity and communicating resonating chambered elements including the cavity and the club shaft. The head core is shaped and dimensioned for balance and for bringing the center of gravity of the club forward. The plate-covered cavity is shaped and dimensioned to control ball deflection for production of accurate top spin of the ball and to minimize damping of sound frequencies therein for transmission to the shaft.

9 Claims, 4 Drawing Figures

FIG. 2
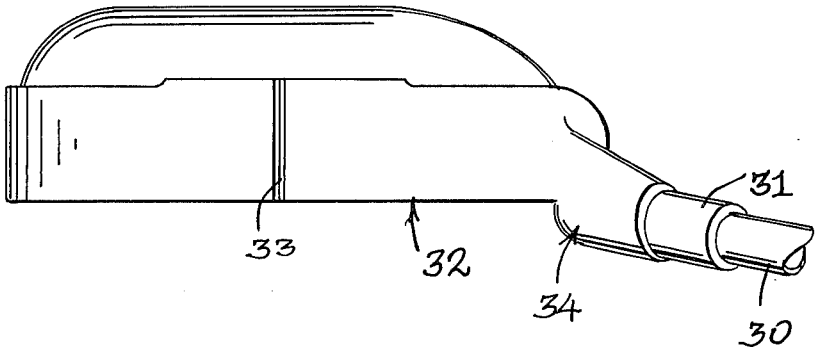
FIG. 3
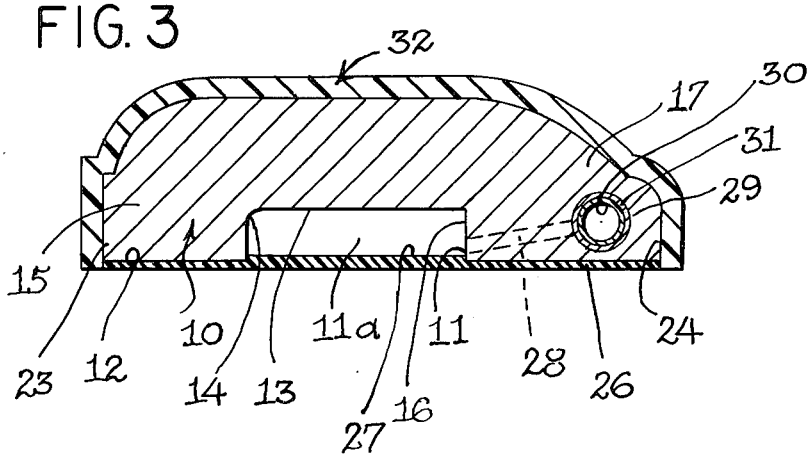
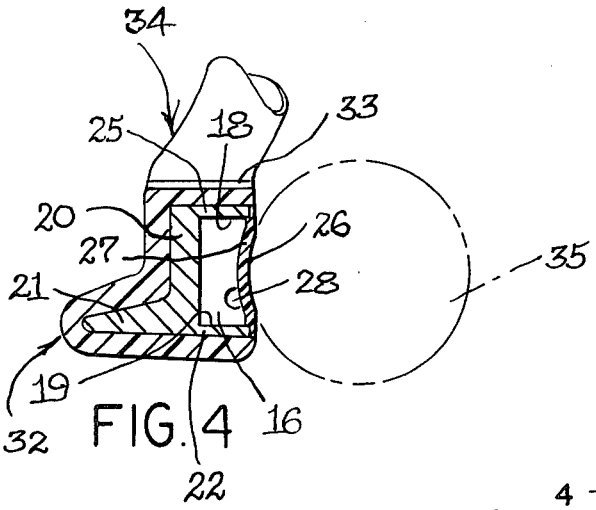
FIG. 4
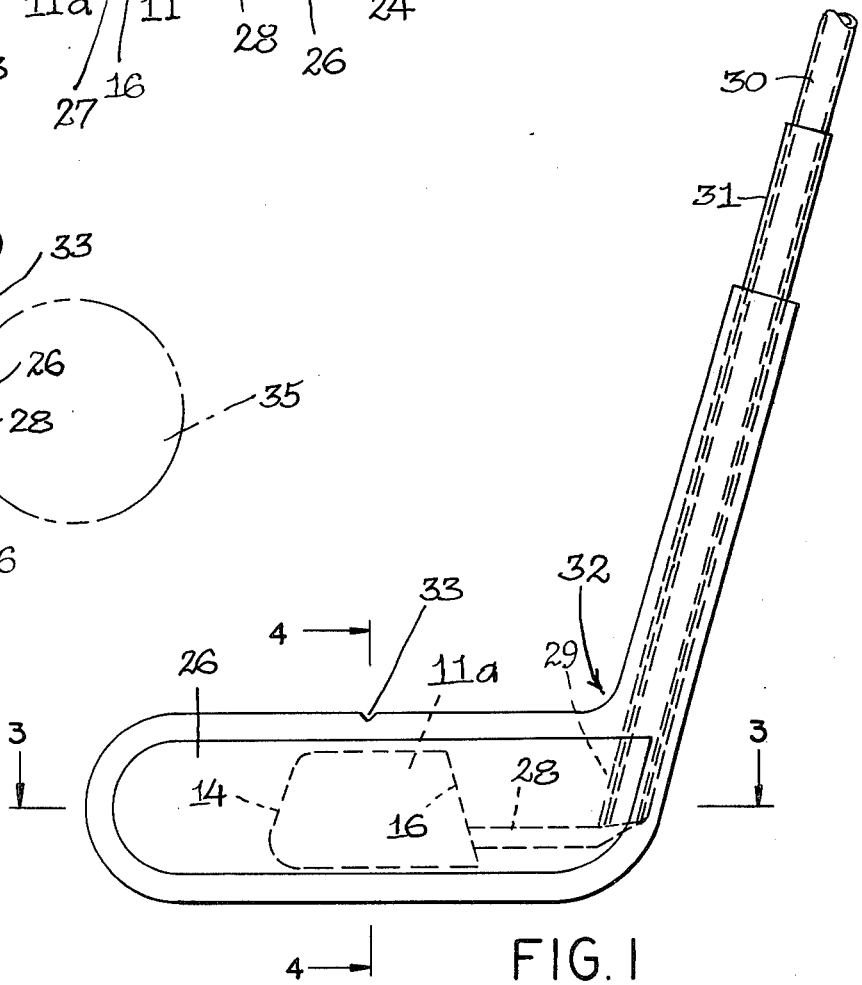
FIG. 1

GOLF CLUB AND MANUFACTURE THEREOF

PRIOR ART AND BACKGROUND

This application is a continuation-in-part of my U.S. patent application filed Apr. 7, 1975 under Ser. No. 565,379 bearing same title as herein, Golf Club and Manufacture Thereof now abandoned, and is also an improvement thereover.

Combined features of the novel structure of the invention herein and distinguishing over the art as presently known include a metallic and cavitied die-cast head core wherein the cavity has a vibratory cover plate and is of a configuration to control ball deflection for accurate top spin roll of the ball and to cooperate for attaining characteristic audible sound-impact waves and to minimize damping of said waves for transmission through the resonating chambers including the hollow shaft for characteristic feel upon ball impact. Also included in said novel combined features of the club structure is the shaping and dimensioning of the head core for proper balancing and for bringing the center of gravity of the club forward, internal communicating channels from the cavity leading to a hosel opening within the head core and in which a hosel element is engaged, encapsulation of the head core and hosel element behind the front wall of the head core, and provision of a hollow shaft member engaging the encapsulated hosel member.

Prior art as presently known and relevant to the invention herein comprises:

U.S. Pat. No. 863,728 Legh, 1907
U.S. Pat. No. 2,040,252 Farrington, 1936
U.S. Pat. No. 3,212,783 Bradley, 1965
U.S. Pat. No. 3,387,844 Shippee, 1968
U.S. Pat. No. 3,390,881 Senne, 1968
U.S. Pat. No. 3,578,332 Caldwell, 1971
U.S. Pat. No. 3,695,618 Wooley, 1972
U.S. Pat. No. 3,817,522 Simmons, 1974
Canadian Pat. No. 692,197 Onions, 1964
Australian Pat. No. 211,781 Cates, 1957
British Pat. No. 24,724 Jerrod, 1892
British Pat. No. 323,897 Dunlap, 1930
British Pat. No. 679,292 Matthews, 1952
British Pat. No. 986,979 Slazenger, 1965

SUMMARY OF THE INVENTION

This invention relates generally to golf clubs including putters, but more specifically to a golf club and method of manufacture involving a cavitied die-cast head core, an impact vibratory plate member over the cavity, sound frequency channels within the head core including a hosel chamber for affixation of a hosel element thereto whereby sound frequencies are conveyable to a hollow shaft attached to the hollow hosel element to impart amplified "feel" to the golf player.

As a definite improvement over my aforementioned copending patent application Ser. No. 565,379, the cavity in this instant application is of specified configuration for minimization of damping of the sound waves or frequencies for transmission of characteristic feel to the player, and the said specified cavity shape also in conjunction with a vibratory cover plate affording the club a better control of ball deflection on impact.

The chamber formed of said cavity further gives a characteristic sound on proper stroking, further cooperates to produce accurate top spin roll of the ball, and the plate further provides greater impact area to insure proper stroking.

A main object of the invention accordingly resides in structure to provide characteristic sound and feel when the golf ball is properly stroked, and to control ball deflection by producing accurate top spin roll of the ball at not only the sweet spot of the club striking area but also at limited areas adjacent to the sweet spot for proper stroking.

Another object of the invention resides in the method of manufacture of the device.

Further objects of the invention are to provide comforting balance and weight distribution in the golf head; to provide a club usable as a practicing instrument to improve skills; to provide a club of strength and endurance and also lending itself to color variations for identification purposes.

The above objects and other incidental ends and advantages of the invention will hereinafter appear in the progress of the disclosure and as pointed out in the appended claims.

BRIEF DESCRIPTION OF DRAWINGS

Accompanying this specification are drawings showing a preferred form of the invention wherein:

FIG. 1 is a side view in elevation of the improved golf club showing the internal chambers of the head core, the shaft in the hosel chamber, the vibratory plate and the plastic encapsulation;

FIG. 2 is a top plan view of FIG. 1;

FIG. 3 is a sectional view of FIG. 1 along the plane 3—3 thereof; and FIG. 4 is a sectional view of FIG. 1 along the plane 4—4 thereof.

DESCRIPTION OF PREFERRED EMBODIMENT

In accordance with the invention and the preferred form shown, the inner head of the golf club and indicated generally by numeral 10 is die-cast with a centrally located recess 11 extending from the front flat face 12 thereof and from suitable metallic materials such as lead or alloys including antimony and tin. Said recess 11 extends inwardly from face 12 of head core 10, said face being adapted to serve as the base for securement thereto of a vibratory plate to form a resonating chamber 11*a* therewith as will appear.

An important aspect of the invention herein is in the shaping and dimensioning of recess 11 toward controlling ball deflection on club impact to impart accurate top spin roll of the ball and toward minimizing damping or interference of induced sound frequencies therein so that a positive characteristic sound for proper stroking may be effected. Moreover, amplified feedback to the golf club shaft of such sound frequencies to effect a positive and characteristic feel on proper ball stroking is accomplished by novel features of a transmission system as will be hereinafter more fully described.

Thus, recess 11 is relatively shallow in depth as best seen in FIG. 3 and is provided with a rear flat wall 13 parallel with front core wall 12, downwardly diverging lateral walls such as rounded wall 14 opposite core toe portion 15 and lateral wall 16 opposite core heel portion 17. Recess 11 also has parallel top and bottom walls 18 and 19 thereby resulting in a substantially trapezoidal shape in the embodiment of the invention herein.

Inner head or core 10 (when encapsulation is resorted to as will hereinafter appear) is suitably dimensioned and shaped for affording proper weighting and balancing characteristics and as shown is provided with the aforesaid front wall 12, a rear wall 20 having an elongated and tapering horizontal bottom flange or apron 21 (for horizontal balance), a bottom wall 22, rounded end walls 23 and 24 and a top wall 25, the bottom and top walls 22 and 25 meeting in curved end walls 23 and 24.

Recess 11 is adapted to provide resonating means in conjunction with a vibratory cover plate 26 suitably secured over core front wall 12 toward the formation of chamber 11*a*. Said vibratory cover plate 26 is adapted to have the necessary strength, flexibility, resiliency and vibratory characteristics in conjunction with recess 11 and with the transmission, amplification and shaft structure means as to effectuate minimization of ball deflection upon ball impact at the sweet spot of said plate 26 and significantly at limited adjacent areas thereof. Upon such ball impact, there is produced accurate top spin roll or overspin of the ball for accurate retention of desired direction. Plate 26, moreover, may be of any suitable material, but in the present embodiment is formed of a plastic such as the composition commercially known as "Lexan".

The shape of chamber 11*a* cooperating with a communicating sound-wave transmitting bore 28 and terminating into an enlarged and communicating hosel-member-receiving opening 29 as best seen in FIGS. 1 and 3 is designed to effectuate: (1) a resonating chamber 11*a* having a minimum of damping effects on all the wave frequencies generated therewithin on ball impact; (2) an outlet (bore 28) for transmission of said frequencies and acting as an escape or safety valve to eliminate energy dissipation of the sound waves within the chamber; and (3) amplification of said waves transmitted through the enlarged opening 29 for vibratory effect of feedback on hollow shaft 30 for characteristic and contemporaneous sound and feel upon proper stroking.

Hollow shaft 30 is in communication with enlarged opening 29 through a hosel member 31 adapted to be suitably secured or joined to inner head core 10 adjacent the bottom of enlarged opening 29, said shaft 30 being suitably secured within and along the member 31 and projecting therefrom.

As shown, transmission bore 28 extends from lateral recess wall 16 within core 10 in an upper and inclined direction (FIGS. 3 and 4) and meets with the enlarged cylindrical opening 29 at core heel portion 17, said opening extending from core top wall 25 and as shown forming an obtuse angle with transmission bore 28. Hosel member 31 is a tube of suitable material such as steel while shaft 30 concentrically mounted and suitably secured therein is of sturdy tubular material such as steel.

Vibratory cover plate 26 for front core wall 12 on the inside face and opposite the entry opening of recess 11 may be thickened as indicated by numeral 27 while the plate itself is suitably secured to wall 12 as by an epoxy or other plastic type adhering means for rendering proper vibratory, resilient and flexible characteristics so as to assure accurate top spin roll of the ball and the sound-feel signals for proper stroking.

Core 10 and hosel 31 may be suitably encapsulated, if desired and as shown in the preferred embodiment, about the perimeter of cover plate 26 as by plastic covering 32, the material used being the plastic known as ABS or equivalent material. It is to be noted here that the center of gravity of the golf head prior to introduction of shaft 30 is substantially central of chamber 11*a* below and along the indicating notch 33 on plastic covered top core wall 18. Moreover, the sweet spot on plate 26 is in direct horizontal alignment therewith. As shown in FIG. 2, the hosel member 31 at the area above the mouth of opening 29 may be suitably offset to bring shaft 30 in any desirable aligning or other relative position with respect to the plane of cover plate 26 for the player's desire.

By the aforesaid construction, the many novel features of the invention become evident. In the first place, differential yieldability and resiliency of cover vibratory plate 26 produces an accurate top spin roll of the ball after impact. This occurs because of the perimetric shape of recess 11, the upper and lower portions of the cover plate opposite the mouth of recess 11 having progressively increasing yield values from top to bottom. In other words, there are hard and soft portions on the striking cover plate 26. Thus, the area about the sweet spot of plate 26 is increased for substantially proper stroking for production of accurate top spin roll of the ball. The spin and roll of the ball is due to the momentary differential yield of plate 26 as above explained. Moreover, the said hard and soft portions of plate 26 perform the function of a negative type of loft angle for the club.

In the second place, the many novel features of the invention by virtue of structure and relative dimensioning of recess chamber 11*a*, transmission bore 28, enlarged hosel member 31 for sound frequency amplification (tantamount to a sound horn) and shaft 30 sturdily mounted inside and along hosel 31 result in production of a specific wave length pattern within chamber 11*a*, amplified along the hosel member and transmitted in the form of a characteristic feel in the shaft of the club and a contemporaneous characteristic sound on proper ball stroking not only at the sweet spot of the club but also at an enlarged area therearound.

As seen in FIG. 4 wherein golf ball 35 shown in phantom at the instant of impact with the golf club, relative dimensions are substantially presented, the several views in the drawing also being substantially in full scale. And as seen in FIGS. 1 and 2, utilization of a light and hollow shaft has the tendency to bring the center of gravity of the club more forwardly of the shaft member. Moreover, precision metal casting for proper and desired weight distribution of the head or core 10 as at heel and toe portions 17 and 15 and at apron 21 (for horizontal balance) contribute to a well-balanced golf head comfortable to use and performing the functions aforesaid.

I wish it understood that minor changes and variations in the materials, integration thereof, relative dimensioning, shape, angulation and positioning of parts and steps of production may all be resorted to without departing from the spirit of the invention and the scope of the appended claims.

It is further understood that the aforestated application Ser. No. 565,379 be incorporated herein by reference.

I claim:

1. A golf club comprising an integral metallic body having toe, heel and flat impact face portions, said face portion having a central recess and the recess having downwardly extending side walls, a resilient and vibratory cover plate secured to said front wall and forming a sound resonating chamber with said recess, a hosel tube, said metallic body having an enlarged opening and in which said hosel tube at the inner end is mounted to form an amplification chamber therewith, a sound wave transmission chamber within said metallic body intermediate said sounding resonating and amplification chambers and communicating with each of said chambers, and a hollow shaft member mounted within and lying along said hosel tube and projecting therefrom whereby accurate top spin roll of the golf ball and characteristic feel and sound are effected on ball stroking by the club at the sweet spot and adjacent areas thereto of the cover plate.

2. A golf club as set forth in claim 1 wherein encapsulating means are provided for said metallic body and the hosel tube secured thereto.

3. A golf club as set forth in claim 1 wherein said integral metallic body having toe, heel and flat impact face portions and the recess is die-cast and wherein encapsulating means are provided for said die-cast body and the hosel tube secured thereto.

4. A golf club as set forth in claim 1 wherein the said sound transmission chamber is an internal bore in the metallic body.

5. A golf club as set forth in claim 1 wherein the center of gravity is forwardly of the said shaft member and is at the center of said resonating chamber.

6. A golf club as set forth in claim 1 wherein said recess has parallel top and bottom walls and a rear wall parallel with said metallic body flat impact face portion.

7. A golf club as set forth in claim 6 wherein the said sound transmission chamber is an internal bore in the metallic body and said amplification chamber is comprised of an opening in said metallic body and the hosel tube secured therewithin.

8. A method for manufacturing golf clubs including the steps of die-casting a metallic body having toe, heel and flat impact face portions and having a recess in the face portion, making an internal bore in said die-cast body from the recess side wall and terminating in an enlarged opening made in said die-cast body, securing a vibratory plate over the face portion of the die-cast body forming a resonating chamber with the recess in said front face, securing a hosel member in said enlarged opening and securing a shaft member in said hosel member.

9. A method for manufacturing golf clubs as set forth in claim 8 wherein an additional step is provided comprising the step of encapsulating the die-cast metallic body and hosel member attached with a plastic covering.

* * * * *